United States Patent [19]

Fletcher

[11] 3,930,570

[45] Jan. 6, 1976

[54] AUTOMATIC LINE FINDER AND LINE COUNTER

[75] Inventor: Steven J. Fletcher, Norristown, Pa.

[73] Assignee: Sperry Rand Corporation, New York, N.Y.

[22] Filed: Jan. 28, 1974

[21] Appl. No.: 436,918

[52] U.S. Cl. ..... 197/19; 197/133 R

[51] Int. Cl.[2] ..... B41J 5/30

[58] Field of Search ..... 197/19, 20, 133 R; 235/102

[56] References Cited

UNITED STATES PATENTS

| | | | |
|---|---|---|---|
| 888,808 | 5/1908 | Hutches | 197/19 |
| 3,174,610 | 3/1965 | Barbagallo et al. | 197/133 R |
| 3,297,124 | 1/1967 | Sims | 197/19 |
| 3,486,005 | 12/1969 | Logerwell et al. | 197/20 X |
| 3,740,531 | 6/1973 | Schinke et al. | 197/20 X |
| 3,757,920 | 9/1973 | Wolf et al. | 197/19 |

*Primary Examiner*—Edgar S. Burr
*Assistant Examiner*—B. T. Rader
*Attorney, Agent, or Firm*—Griffin, Branigan and Butler

[57] ABSTRACT

An automatic line finder and line counter apparatus is provided for use with an automatic typewriter system of the type including a typewriter and a magnetic record unit. The line finder and line counter comprises thumbwheel switches, a counter, and logic circuit means responsive to signals from the counter and the automatic typewriter system for controlling the line spacing or indexing mechanism of the typewriter. When the typewriter system is not in the automatic playback mode in the line finder and line counter apparatus performs normal line finding and normal line counting. When the system is in the automatic playback mode the line find and line counter apparatus performs automatic line finding and automatic line counting. Automatic line finding permits unattended continuous playback of variable length messages on constant length continuous forms.

14 Claims, 5 Drawing Figures

| | OUTPUT | | | |
|---|---|---|---|---|
| DIAL | Q0 | Q1 | Q2 | Q3 |
| 0 | | * | * | |
| 1 | * | * | | * |
| 2 | * | | * | |
| 3 | | * | | |
| 4 | * | | | |
| 5 | | | | |
| 6 | | | | * |
| 7 | | | * | |
| 8 | | * | | * |
| 9 | * | | * | * |

AUTOMATIC LINE FINDER AND LINE COUNTER

BACKGROUND OF THE INVENTION

The present invention relates to improvements in automatic typewriter systems of the type comprising a typewriter and a magnetic record unit. These systems include a typewriter for typing characters on a form or sheet of paper held in the typewriter line spacing or indexing mechanism, and a magnetic card or tape unit for recording or storing signals representing the character keys actuated by an operator. The sytem may be operated in a LOCAL mode whereby it functions as a conventional typewriter, a RECORD mode wherein signals representing the actuated keys are recorded on a magnetic record, or in a PLAYBACK mode wherein signals stored on the magnetic record are played back to control the typing mechanism. When operated in the PLAYBACK mode, the sytem may play back the signals representing either one character, one word, one line, or one paragraph, depending on which one of several actions keys is depressed by the operator. On the other hand, if the operator depresses an automatic action key while the system is in the PLAYBACK mode the system automatically plays out and types the recorded data until a STOP code is sensed.

Conventionally, a STOP code has been employed to terminate automatic playback at the end of a message that is less than one page in length, or at the end of each page and at the end of the message when the message extends over one page. When the STOP code is sensed the system stops and the operator inserts a new sheet of paper or, if continous forms are being used, manually advances the index mechanism to bring the first typing line of the next sheet into the typing position. Thus, the attention of the operator is required at least once for each page typed.

In the prior art, the line finding and line counting (pagination) functions have conventionally been performed by separate mechanisms. The pagination function has been performed by a counter which has been incremented or decremented as each line is typed. When the count reaches a predetermined value the counter emits a signal to indicate that the last line to be typed on that page has been typed. The line finding mechanisms of the prior art have comprised overhead tractor feeds with or without a special motor, or coded tapes, beaded chains, or cams. These mechanisms for finding the first line of the next sheet of a continuous form are not only bulky and expensive, but frequently require repair.

SUMMARY OF THE INVENTION

An object of the present invention is to provide means for controlling an automatic typewriter system whereby continuous playback of variable length messages on constant length continuous forms is accomplished without requiring the attention of the operator.

An object of the invention is to provide for an automatic line finding and automatic pagination when the system is operating in the automatic playback mode.

An object of the invention is to provide means for performing normal line finding and normal pagination when the system is not operating in the automatic playback mode.

A further object of the invention is to provide apparatus wherein a single counter is utilized to accomplish both the line finding and the line counting functions.

The above stated and other objects of the invention are accomplished by the provision of manually operated switch means, a counter, logic circuit means responsive to signals from the counter and the automatic typewriter system for controlling the counter and generating index signals, a means responsive to the index signals for advancing a form and index means associated with the automatic typewriter system. The switch means is manually set to a predetermined count which may be either the maximum number of lines to be typed on a page if pagination is to be performed, or the number of lines between the first typing lines of two adjacent sheets of a continuous form if line finding is to be performed. The logic circuit means includes means responsive to signals from the automatic typewriter system and the counter for producing signals to decrement the counter, transfer the value set into the switch means into the counter, advance the paper index mechanism of the typewriter, and control the automatic typewriter system, the particular signals produced varying according to the count in the counter and the typewriter system operating mode.

Other objects of the invention and its mode of operation will become apparent upon consideration of the following description and the accompanying drawings.

DESCRIPTION OF A PREFERRED EMBODIMENT

Figures 1, 2:
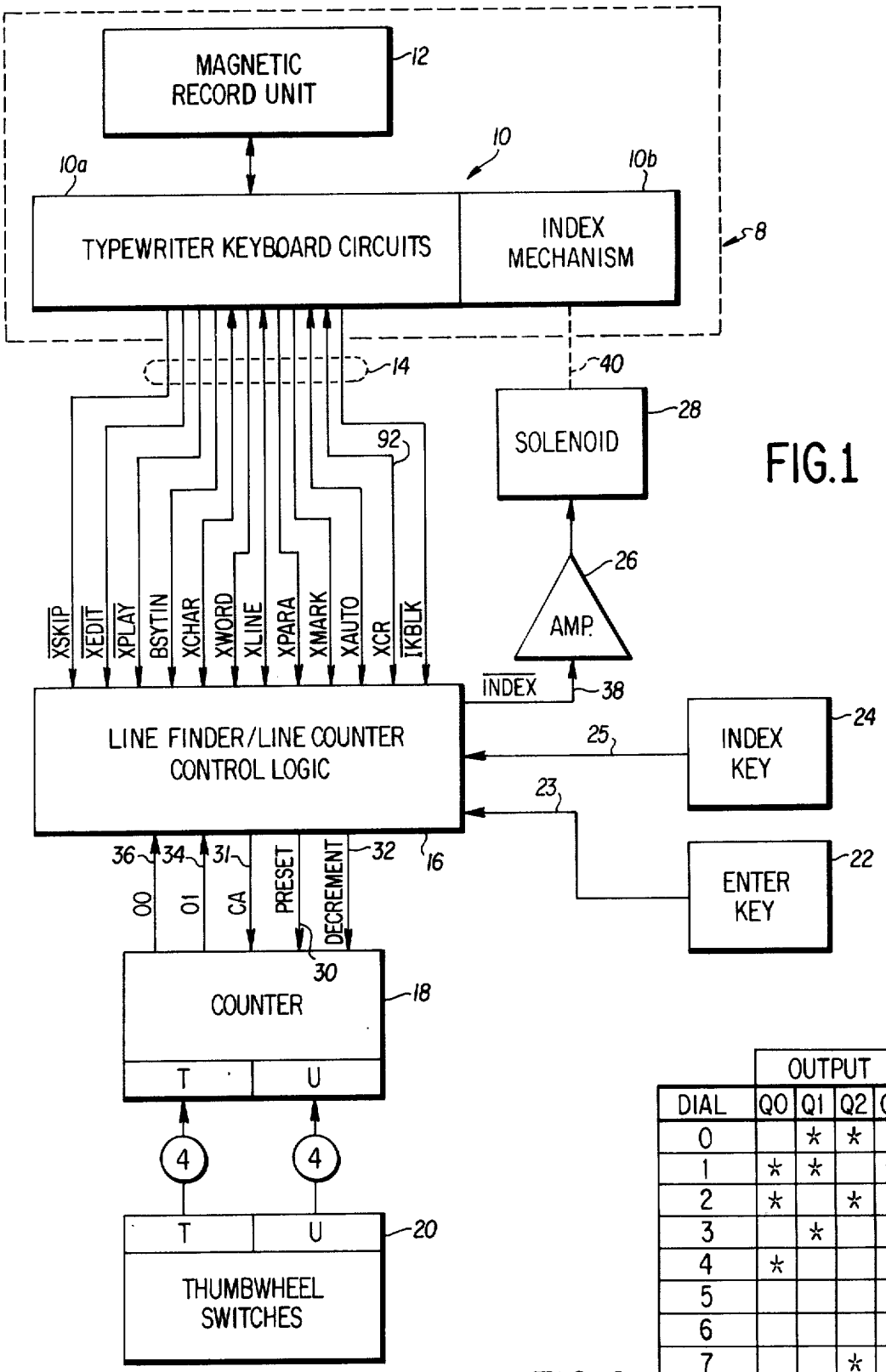
FIG. 1 is a block diagram of the invention showing its relationship to an automatic typewriter system of the prior art.
FIG. 2 is a table showing the code employed by the thumbwheel switches and the counter.

The system — FIG. 1

FIG. 1 shows a typical automatic typewriter sytem 8 comprising a typewriter 10 and a magnetic record and a data processor unit 12. The automatic typewriter system 8 may, for example, be one of the word processing systems such as the magnetic tape or magnetic card systems currently marketed by the Sperry Rand Corporation. The typewriter 10 includes keyboard circuits **10*a* for generating various signals in response to depression of keys on the typewriter keyboard, and an index mechanism 10*b* for vertically indexing or line spacing either sheet-type forms or continuous forms which are initially inserted into the typwriter 10 by an operator. The typewriter 10** may be constructed as disclosed in U.S. Pat. No. 3,757,920.

The magnetic record and data processor unit 12 is responsive to operation of the various keys on the typewriter keyboard to record data on a magnetic tape or card. In addition, the unit 12 is also responsive to operation of various keys on the typewriter keyboard to read information recorded on the tape or card and supply it to the typewriter 10 where it is printed on the form held by the index mechanism **10*b***.

Since the word processing system 8 is a commercially available system well known in the art, and since the system 8 requires no modification for use with the present invention, its operation will not be described in detail. However, actuation of some of the keys on the typewriter keyboard produces signals which are used by the circuits of the present invention hence a brief explanation of the opeations performed in response to actuating of these keys will aid in understanding the operation and utility of the present invention.

The typewriter keyboard includes the normal complement of keys representing numeric and alphabetic characters. In addition, the keyboard includes a plurality of mode keys and action keys including RECORD, PLAY, ADJUST, SKIP and EDIT mode keys and CHARACTER, WORD, LINE, PARAGRAPH, AUTO and FIND MARK action keys.

When the RECORD mode key is depressed it places the system 8 in condition to record on a magnetic record signals representing text material that is entered into the system 8 by subsequently actuating the various numeric and alphabetic keys on the keyboard. After the RECORD mode key is depressed, the usual procedure is to record a reference mark. Reference marks are used to define the starting point of lines, pages, or paragraphs, depending on the particular job being performed, and enable the system to locate specific passages of material when it is subsequently desired to play back and automatically type this material. A reference mark is recorded by depressing a CODE key on the keyboard while at the same time depressing the EQUAL key. After the reference mark is recorded, a required carrier return signal is recorded on the record by depressing the CODE key while at the same time depressing the carrier return key. After this has been done, the text material can be recorded by actuating the alphabetic and numeric keys in the conventional manner. After the text material has been recorded, a STOP code must be recorded. The purpose of the STOP code is to indicate to the system 8 wherein it should stop playback when the material recorded on the record is subsequently played back and typed by the typewriter 10.

When the PLAY mode key is depressed it places the system 8 in condition to playback and type information previously recorded on the magnetic record. The text is typed exactly as it was recorded, line for line. The action of the system when it is in PLAYBACK mode is determined by which of the action keys is depressed. Each time the CHARACTER key is depressed the system 8 will play back and type one character and stop. When the WORD key is depressed the sytem 8 plays back and types one word before stopping. Each actuation of the LINE key causes one complete line of text to be typed and a carrier return operation to take place. The carrier return operation moves the typing head of the typewriter 10 back to the left margin. Each depression of the PARAGRAPH key causes the system 8 to play back and type one paragraph of text after which a carrier operation takes place and the machine stops.

When the AUTO key is depressed while the system 8 is in the PLAYBACK mode, it initiates a playback operation and text is typed out until a STOP code is sensed on the magnetic record. When the FIND MARK key is depressed text material is played back from the record and typed by the typewriter 10 until a reference mark is sensed on the record.

The ADJUST mode key is used in a manner similar to the PLAYBACK mode key described above. However, in the ADJUST mode the right margin of the printed text is adjusted to within seven characters of the margin set on the typewriter 10 so that the text is not typed line for line as is done in the PLAYBACK mode.

Depression of the EDIT mode key conditions the system 8 to both playback and record. Playback takes place from one magnetic record and the playback information is recorded on a second magnetic record. As the text is transferred it is printed by the typewriter 10. Additional text material may be recorded on the second magnetic record by operating the keys on the keyboard. The action keys are utilized to control the length of the text transferred from the first to the second magnetic record. For example, one depression of the WORD key will cause one word to be transferred from the first to the second magnetic record if the system 8 is in the EDIT mode.

The SKIP key is used in conjunction with the action keys to skip portions of the recorded text when operating in the EDIT mode. For example, depression of the SKIP and WORD keys will cause the system to skip over the next word recorded on the magnetic record. The skipped word is not typed by the typewriter 10 nor is it rerecorded on the second magnetic record.

In accordance with the present invention the signals representing the status of the mode and action keys are made available at a connector terminal and are connected by way of a cable 14 to a line finder/line counter control logic circuit 16. Also included in the cable 14 are leads for carrying three further signals designated XCR, BSYTIN and $\overline{\text{IKBLK}}$. The signal XCR is available from the typewriter keyboard circuits 10*a* anytime a carrier return operation takes place. The carrier return may be initiated by depression of the CARRIER RETURN key on the keyboard, or by sensing a CARRIER RETURN code played back from the magnetic record after having been recorded thereon at the end of each line of recorded text.

The $\overline{\text{IKBLK}}$ is a keyboard interlock signal available from the keyboard circuits 10*a* and indicates when the keyboard is locked. The keyboard is locked under several conditions such as when data is being transferred from magnetic record unit 12 to the typewriter 10. The keyboard is also locked when the system 8 is in a SKIP mode, when a keyboard-initiated carrier return takes place, and when an error situation occurs as a result of system malfunction or operator error. When the system is operating in the output mode, the keyboard is also locked during the time each character is being processed, and at other times such as when a carrier return operation occurs. The keyboard is continuously locked when the typewriter system 8 is in the automatic playback mode.

The signal BYSTIN occurs anytime the typewriter 10 is performing a character print cycle or a function cycle such as a carrier return or tab.

In addition to cable 14 and control logic 16, the present invention comtemplates the provision of a counter 18, thumbwheel switches 20, an ENTER key 22, an INDEX key 24, an amplifier 26, and a solenoid 28.

When the invention is used as a line counter thumbwheel switches 20 are used to manually enter into the system of FIG. 1 an indication of the maximum number of lines that should be typed on each form inserted into the index mechanism 10*b*. When used as an automatic line finder, the value entered into the thumbwheel switches 20 is equal to the number of printing lines between the first printing lines on two consecutive sheets of a continuous form. Two thumbwheel switches 20 are provided, one for the units order and one for the tens order. Each switch 20 provides a coded output on four output lines to indicate the number that has been set into the switch 20. The switches 20 may be of the type manufactured by Amp, Inc. (Manufacturer's part number SC2-406-1) but wired to produce an output code in accordance with the table shown in FIG. 2.

The coded output from the units order thumbwheel switch 20 is applied to the units order of counter 18 while the coded output from the tens order thumbwheel switch 20 is applied to the tens order of the counter 18. The counter 18 receives the signals PRESET and CA over leads 30 and 31 from the control logic 16 and in response to these signals assumes a count corresponding to the value set into the thumbwheel switches 20. The counter 18 also receives the signal DECREMENT over a lead 32 and in response to this signal the value in the counter 18 is decreased by one. The counter 18 provides two output signals over leads 34 and 36 to indicate to the control logic 16 when the count in the counter 18 has been decremented to 01 and 00, respectively.

The ENTER key 22 acts through control logic 16 to generate the PRESET and CA signals on leads 30 and 31. Thus, an operator may set a value on the thumbwheel switches 20 and then depress the ENTER key 22 to cause the value to be entered into the counter 18.

The INDEX key 24 if provided to permit line finding under control of the operator. When key key 24 is depressed the control logic 16 issues a sequence of DECREMENT signals on lead 32 and for each of these DECREMENT signals it issues a $\overline{\text{INDEX}}$ signal on a lead 38 which is applied to the amplifier 26. When the counter 18 has been decremented to zero, the $\overline{\text{INDEX}}$ pulses are terminated. The $\overline{\text{INDEX}}$ pulses are applied through amplifier 26 to the solenoid 28 which actuates a mechanical linkage 40. Mechanical linkage 40 is connected to the typewriter index mechanism **10*b* whereby each of the pulses on the lead 38 causes the index mechanism 10*b* to operate thereby line spacing the paper in the index mechanism 10*b*** upwardly one line.

As is apparent from FIG. 1, the present invention may be added to the existing automatic typewritier system 8 with only a minimum of modification to the system 8. All that is required is the mechanical linkage 40 for operating the index mechanism **10*b*, and a connector by means of which the cable 14 may be connected to the typewriter keyboard circuits 10*a***.

THE COUNTER — FIG. 3

Figure 3:
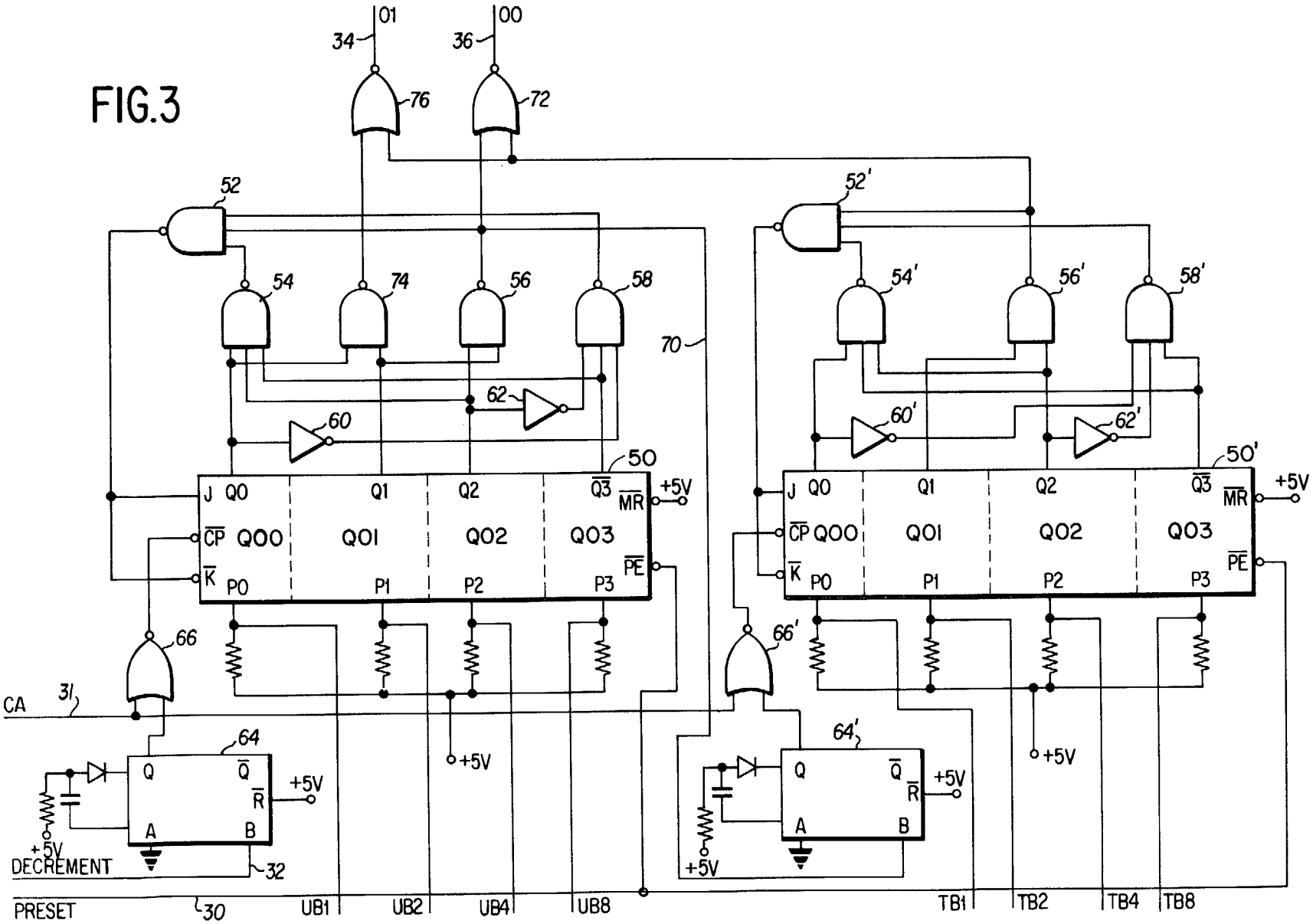
FIG. 3 is a logic diagram of the counter.

FIG. 3 shows the details of the counter 18. Referring to the units denominational order, each order of the counter 18 includes a four bit binary shift register 50, a plurality of NANDS 52, 54, 56 and 58, a pair of inverters 60 and 62, a monostable multivibrator 64, and a NOR 66.

The shift register 50 may be a Fairchild Model 9300 universal shift register comprising four binary stages Q00–Q03 having input terminals P0, P1, P2, and P3 and output terminals Q0, Q1, Q2 and $\overline{Q}3$. The input terminals P0, P1, P2 and P3 of shift register 50 are connected by way of leads UB1, UB2, UB4, and UB8 to the output terminals of the units order of thumbwheel switches 20. Signals representing the value set on the units order of thumbwheel switch 20 are entered in parallel into the shift register 50 if the signal applied to input terminal $\overline{\text{PE}}$ is at the low level at the time there is a transition of the voltage at the input terminal $\overline{\text{CP}}$ from the high level to the low level. As subsequently explained, this is accomplished by applying a high level signal CA over the lead 31 to NOR 66 while the signal PRESET on lead 30 is at a low level.

In order to provide the counting function, the NANDS 52, 54, 56 and 58 logically combine the signals from the four stages of the shift register 50, and the output of NAND 52 controls the state to which shift register stage Q00 is set upon occurrence of the next low-going transition of the voltage at input terminal $\overline{\text{CP}}$. The output of shift register stage Q00 is applied to NAND 54 and through inverter 60 to NAND 58. The output of shift register stage Q01 is applied to NAND 56. The output of shift register stage Q3 is applied to NANDS 54, and 56, and through inverter 62 to NAND 58. The output of the active low side ($\overline{Q}3$) of the fourth stage of the shift register 50 is connected to NANDS 54 and 58. The outputs of NANDS 54, 56 and 58 are applied as inputs to NAND 52 and the output of NAND 52 is applied to the J and $\overline{K}$ inputs of the first stage of the shift register 50.

The count standing in shift register 50 is decremented by one each time a positive-going DECREMENT signal appears on lead 32. This signal triggers the monostable multivibrator 64 and the resulting positive-going output from the multivibrator 64 drives the output of NOR 66 toward the low level. Assume for example that the value 9 has been entered into shift register 50 from the thumbwheel switch 20. From FIG. 2 it is seen that the signals appearing at terminals Q0 and Q2 will be at the high level while the signals appearing at terminals Q1 and $\overline{Q}3$ will be at the low level. The signal appearing at terminal $\overline{Q}3$ blocks NANDS 54 and 58 while the signals appearing at terminal Q1 blocks NAND 56. With the ouptut of NANDS 54, 56 and 58 all at the high level NAND 52 produces a low level output signal that is applied to the J and $\overline{K}$ input terminals of stage Q00. Nothing happens until a DECREMENT signal on lead 32 causes the voltage at input terminal $\overline{\text{CP}}$ to drop from the high to the low level. When this occurs the content of each stage of the shift register 50 is shifted one stage to the right and, because of the low level input to terminals J and $\overline{K}$, the leftmost stage is set so that the signal appearing at terminal Q0 is at the low level. The counter 18 now contains a count of 8.

Since shift register counters are well known in the art, a detailed description of the successive decrementations of the counter 18 is believed unnecessary. It is sufficient to state that the counter 18 counts and produces output signals in accordance with the code shown in FIG. 2.

The tens order of the counter 18 is identical to the units order described above. However, the four input terminals P0, P1, P2, and P3 of the tens order are connected to the coded outputs of the tens order thumbwheel switch 20. Furthermore, the tens order counter is not decremented by a signal from an external source but is instead decremented each time the units order changes from 0 to 9. As shown in FIG. 2, the signals appearing at terminals Q1 and Q2 are both at the high level when the units order of the counter 18 contains a count of zero. As a result, the output of NAND 56 is at the low level. When the count changes from 0 to 9, the signal sppearing at terminal Q1 drops to the low level thus producing a positive-going signal at the output of NAND 56. This signal is applied over a lead 70 to trigger the monostable multivibrator 64'. The output of multivibrator 64' drives the output of NOR 66' toward the low level thus decrementing by one the count in shift register 50'.

As previously stated, the output of NAND 56 in the units order is at the low level anytime the units order of the count is zero. The output of NAND 56 is applied to one input of a NOR NAND 72. In like manner, the output of NAND 56' in the tens order of the counter 18 is at the low level when the tens order digit is zero. The output of NAND 56' is applied to a second input of NOR NAND 72. Therefore, when the count in the counter 18 has reached a value of zero NOR 72 produce a high level signal on lead 36.

A NAND 74 is provided for sensing when the count in the units order of the counter 18 has a value of one. The inputs of NAND 74 are connected to output terminals Q0 and Q1 of the register 50 and the output of the NAND 74 is connected to one input of a NOR 76. The second input of NOR 76 is connected to the output of NAND 56'. Therefore, when the count in counter 18 has reached a value of 01 NOR 76 produces a high level signal on lead 34.

DECREMENTING THE COUNTER - NORMAL

Figure 4:
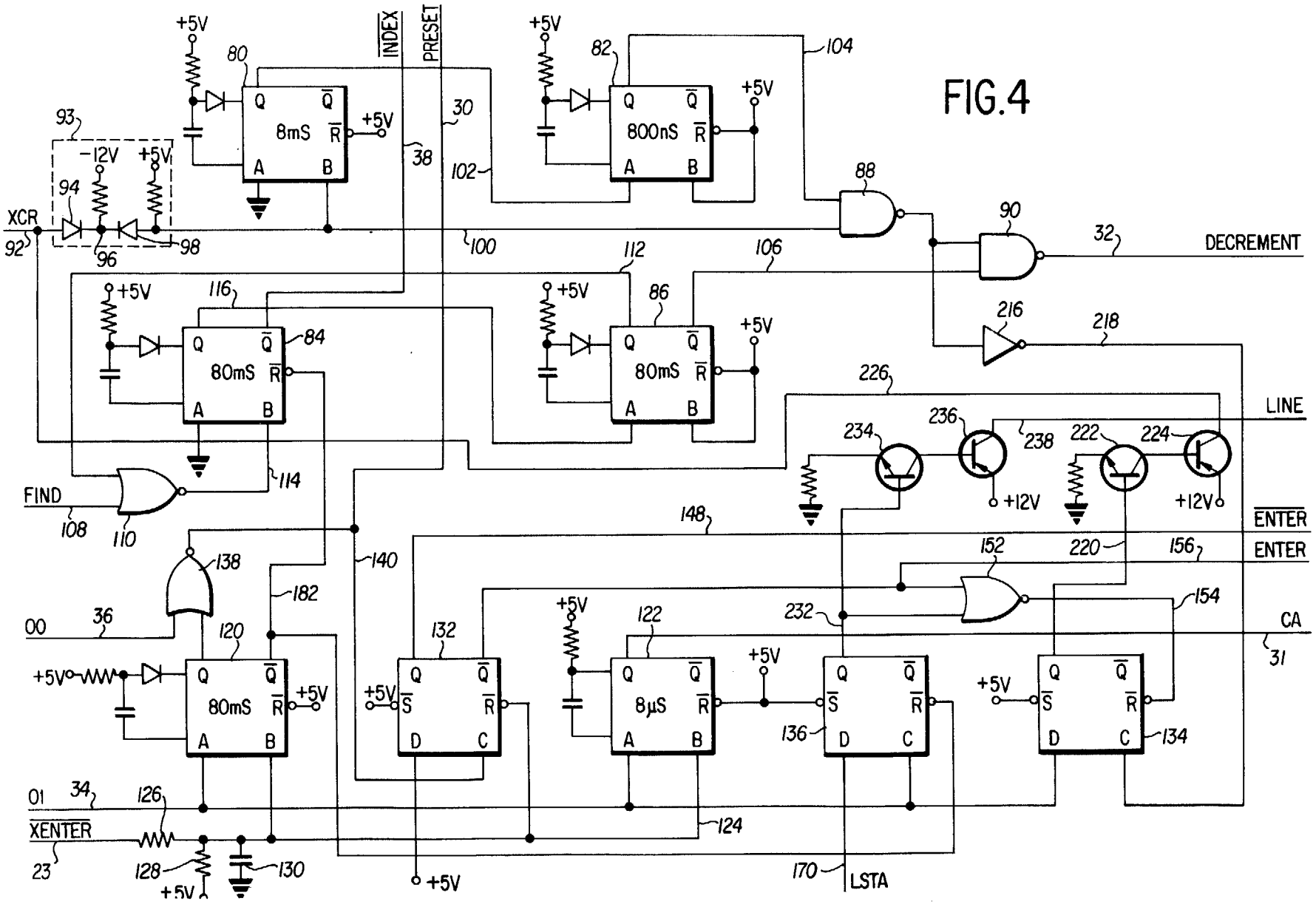
FIGS. 4 and 5 are logic diagrams of the control circuits of the invention.

The circuits for decrementing the counter 18 are shown in the upper portion of FIG. 4 and include two monostable multivibrators 80 and 82, which may be Fairchild type 74123 multivibrators, and two NANDS 88 and 90. Generally speaking, these circuits generate a DECREMENT signal on lead 32 to decrement to counter 18 each time a carrier return operation is executed by the typewriter 10. The carrier return signal XCR is applied to FIG. 4 from the typewriter 10 over a lead 92. The lead 92 is connected to an interface or level shifting circuit 93 including a pair of face to face diodes 94 and 98, the cathodes of the diodes 94 and 98 being connected through a first resistor to a negative voltage source and the anode of diode 98 being connected through a second resistor to a positive voltage source. The resistor and voltage source values are chosen such that the anode of diode 98 is at a low level when XCR is low, but rises to the value of the positive voltage source when XCR rises to the high level to block diode 98.

The anode of diode 98 is connected by a lead 100 to the B input of monostable multivibrator 80 and one input of NAND 88. The Q output from multivibrator 80 is connected by a lead 102 to the A input of multivibrator 82, and the Q output from multivibrator 82 is connected by a lead 104 to a second input of NAND 88.

Normally the XCR signal on lead 92 is at the logic zero or low level but upon occurrence of a carrier return operation the signal on lead 92 rises to the logic one or high voltage level. The resulting high level signal on lead 100 conditions one input of NAND 88 and triggers monostable multivibrator 80. When the multivibrator 80 is triggered, its Q output rises to the high level and remains for 8 milliseconds. At the end of the 8 millisecond interval the multivibrator 80 returns to its initial state and the negative-going signal on lead 102 triggers multivibrator 82. When multivibrator 82 is triggered the signal on lead 104 rises to the high level for a period of 800 nanoseconds thereby conditioning the second input of NAND 88. If the voltage level on lead 100 is still at a high level when multivibrator 82 is triggered, the output of NAND 88 drops to the low level thereby blocking one input to NAND 90. As will be evident subsequently, the signal on lead 106 is positive at this time, hence, when NAND 90 is blocked by the output from NAND 88, the signal on lead 32 rises to the high level. This signal is applied to monostable multivibrator 64 in FIG. 3 thus triggering the units order of the counter 18 to decrement in the manner described above.

Since the signal XCR results from operation of contacts on the keyboard, the purpose of multivibrators 80 and 82 is to permit the signal XCR to stabilize before it is sampled. Multivibrator 80 provides an 8 millisecond delay interval during which the stabilization may take place, and multivibrator 82 produces an 800 nanosecond signal to sample the XCR signal at NAND 88.

DECREMENTING THE COUNTER-THE INDEX SEQUENCE

Under certain conditions which are subsequently explained in detail, it is necessary to generate a sequence of one or more decrement pulses on the lead 32 and, for each of these pulses, to send a pulse to the index mechanism **10*b* which causes the index mechanism 10*b* to space the form therein one line. Monostable multivibrators 84 and 86 comprise the means for generating these pulses. The index sequence occurs when the signal FIND on lead 108 drops to the low level. Lead 108 is connected to one input of a NOR circuit 110 which has a second input 112 connected to the Q output of multivibrator 86. The Q output of multivibrator 86 is normally at the low level hence when the FIND signal drops to the low level NOR 110 produces a positive-going signal on lead 114 to trigger multivibrator 84.**

When multivibrator 84 is triggered its $\overline{Q}$ output drops to the low level thus generating the signal $\overline{\text{INDEX}}$ on lead 38. As shown in FIG. 1, the $\overline{\text{INDEX}}$ signal is applied through an amplifiier 26 to a solenoid 28. The solenoid 28 acts through a mechanical linkage 40 to operate the index mechanism **10*b* thereby spacing the form in the index mechanism 10*b*** upwardly one line.

When multivibrator 84 is triggered its Q output appearing on lead 116 rises to the high level. At the end of an 80 millisecond interval multivibrator 84 returns to its initial state and the voltage on lead 116 returns to the low level. The negative-going signal triggers multivibrator 86 causing the signal on lead 106 to drop to the low level while the signal on lead 112 rises to the high level. The low level signal on lead 106 blocks NAND 90 thereby producing a positive-going DECREMENT pulse on lead 32. This pulse decrements the counter 18 as previously described.

Multivibrator 86 provides an 80 millisecond delay interval during which the solenoid 28 (FIG. 1) is deenergized and returned to its initial condition. As the end of the 80 millisecond interval the multivibrator 86 returns to its initial condition and the signal on lead 112 returns to the low level. If the FIND signal on lead 108 is still at the low level at the time the signal on lead 112 drops to the low level, NOR 110 produces another positive-going pulse to again trigger multivibrator 84. This initiates another cycle of operation of multivibrators 84 and 86 as described above and during this cycle another signal $\overline{\text{INDEX}}$ and another DECREMENT signal are generated. The index sequence continues until the FIND signal on lead 108 rises to the high level. When this occurs the low level signal on lead 112 cannot retrigger multivibrator 84 so the sequence stops. The manner in which the FIND signal is generated is described subsequently.

THE RESET AND TRANSFER ROUTINE

The logic circuits 16 are initialized or reset and the line count set into the thumbwheel switches 20 is transferred to the counter 18 by a Reset and Transfer Routine. This routine is initiated when the power is turned on, when the ENTER key 22 is depressed, or when the count in the counter 18 is decremented to zero.

In the lower portion of FIG. 4, two monostable multivibrators 120 and 122 have their B inputs connected to a lead 124. Lead 124 is connected through a resistor 126 and the lead 23 to the ENTER key contacts, through a resistor 128 to a source of positive voltage, through a capacitor 130 to ground and to the $\overline{R}$ input of a bistable flipflop 132. Flipflop 132 is a D-type flipflop and may, for example, be a Fairchild type 7474.

The lead 34, which carries a signal indicating when the count in counter 18 has reached 01, is connected to the D input of a D-type flipflop 134, the C input of a D-type flipflop 136, and the A inputs of multivibrators 120 and 122. The Q output of multivibrator 120 is connected to a NOR 138. The lead 36, which carries a signal indicating when the counter 18 contains a count of 00, is connected to a second input of NOR 138. The output of NOR 138 is the signal PRESET. It is applied over a lead 140 to the C input of flipflop 132 and over the lead 30 to the $\overline{PE}$ terminals of the universal shift registers 50 and 50' (FIG. 3). The lead 30 is also connected to one input of a NAND 142 (FIG. 5) and is further connected by a lead 144 to the $\overline{R}$ input of a D-type flipflop 146.

Figure 5:
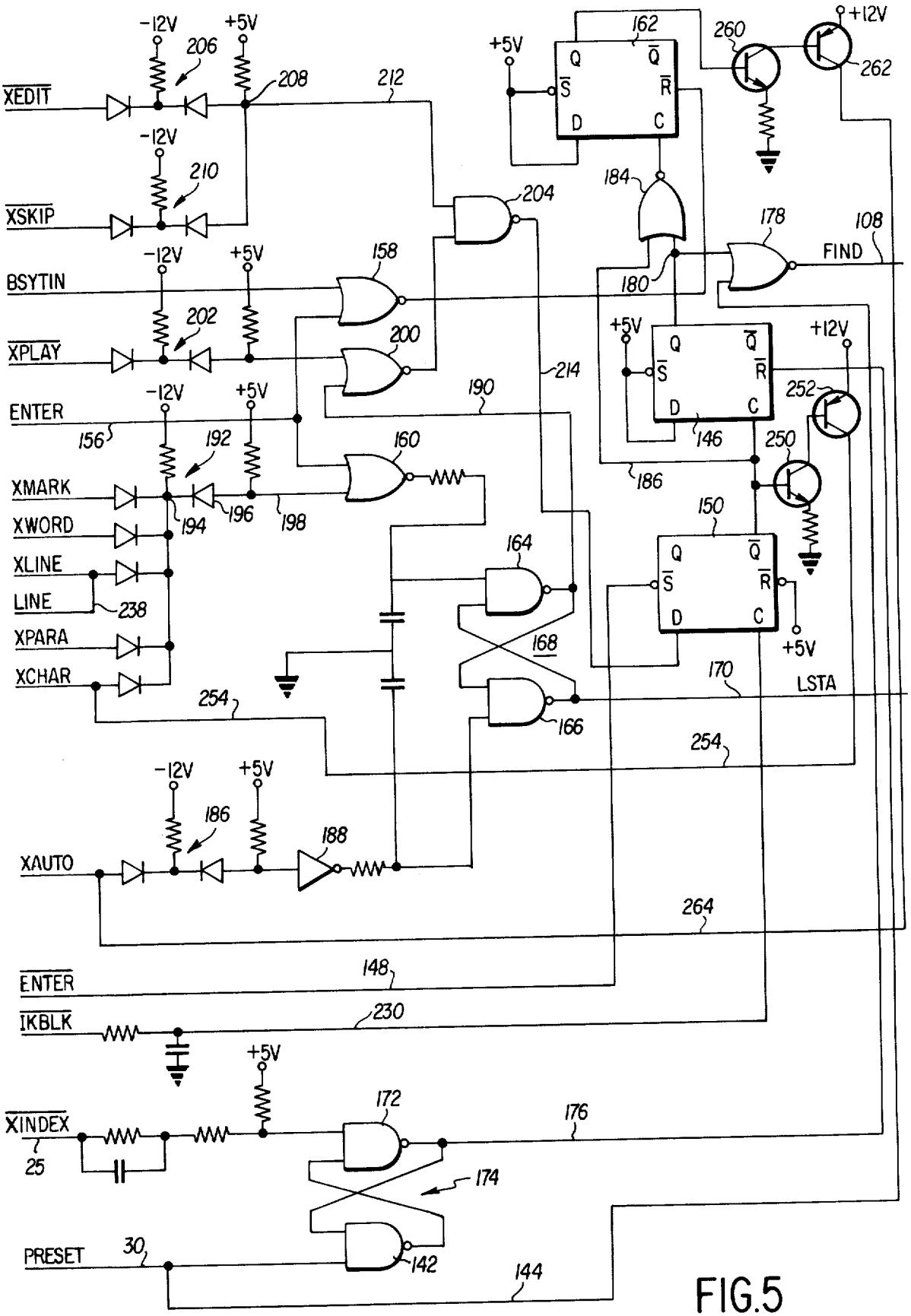

The Q output of flipflop 132 is the signal $\overline{ENTER}$. This signal is applied over a lead 148 to the $\overline{S}$ input of a D-type flipflop 150 (FIG. 5). The $\overline{Q}$ output of flipflop 132 is the signal ENTER. It is applied to one input of a NOR 152, the output of the NOR 152 being connected by a lead 154 to the $\overline{R}$ input of flipflop 134. The signal ENTER is also applied over a lead 156 to the inputs of two NORS 158 and 160 (FIG. 5). The output of NOR 158 is connected to the R input of a D-type flipflop 162 and the output of NOR 160 is connected to one input of a NAND 164. NAND 164 is cross coupled with a further NAND 166 to form a flipflop 168. The output of NAND 166 is the signal LSTA which is applied over a lead 170 to the D input of flipflop 136 (FIG. 4).

As previously stated, depression of the ENTER key 22 resets the logic circuits and causes the transfer of the count in the thumbwheel switiches 20 to the counter 18. When the ENTER key 22 is depressed the signal $\overline{XENTER}$ (FIG. 4) momentarily drops to the low level. The resulting low level signal on lead 124 resets the flipflop 132 thereby driving the signal $\overline{ENTER}$ on lead 148 to the low level. This low level signal sets flipflop 150 (FIG. 5). As flipflop 132 is reset the positive-going signal ENTER is inverted by NOR 152 and the output of the NOR 152 resets flipflop 134. The ENTER signal is also applied over the lead 156 to FIG. 5 where it is inverted by NOR 158 to become a reset signal for flipflop 162. The ENTER signal on lead 156 is also inverted by NOR 160 to become a reset signal for the flipflop 168.

The signal $\overline{XENTER}$ remains at the low level only momentarily and then returns to the high level. The resulting positive-going signal on lead 124 triggers both of the multivibrators 120 and 122, provided the signal on lead 34 is at the low level.

When multivibrator 120 is triggered its Q output goes to the high level for a period of 80 milliseconds. This signal is inverted by NOR 138 and the resulting low level PRESET signal on lead 30 is applied to the $\overline{PE}$ terminals of the shift registers 50 and 50'. When multivibrator 122 is triggered its Q output rises to the high level and the signal CA is applied over lead 31 to the NORS 66 and 66' (FIG. 3). The NORS 66 and 66' produce negative-going output signals that are applied to the $\overline{CP}$ input terminals of the shift registers 50 and 50'. The negative-going signals at the input terminals $\overline{CP}$, in combination with the low level PRESET signal being applied to the input terminals PE, condition the shift registers 50 and 50' to receive combinations of signals representing the value set into the thumbwheel switches 20.

In addition to conditioning the shift registers 50 and 50', the low level signal PRESET performs certain circuit resetting functions. In FIG. 5, it blocks NAND 142 which is cross coupled with a NAND 172 to form a flipflop 174. NAND 172 is further connected to receive the signal $\overline{XINDEX}$ from the index key 24. The signal $\overline{XINDEX}$ is normally at a high level so when NAND 142 is blocked by the PRESET signal NAND 172 produces a low level output signal on lead 176. The lead 176 is connected to one input of a NOR 178. The PRESET signal on lead 30 also passes over lead 144 to reset the flipflop 146. When the flipflop 146 is reset the low level signal at its Q output is applied over lead 180 to a second input of NOR 178. The NOR 178 produces a high level FIND signal on lead 108 that is applied to NOR 110 (FIG. 4). NOR 110 produces a negative-going signal on lead 114 but this signal has no effect on multivibrator 84 since it takes a positive-going signal to the B input to trigger the multivibrator 84. Furthermore, since multivibrator 120 is still active a low level signal is being applied over lead 182 to the $\overline{R}$ input of multivibrator 84. This low level signal overrides any input to the B input terminal of the multivibrator 84 and also holds flipflop 136 reset.

When flipflop 146 is reset it applies a low level signal to one input of a NOR 184. NOR 184 is already receiving a low level signal over lead 186 from the flipflop 150 which has been previously set. NOR 184 therefore produces a positive-going output signal which would normally set flipflop 162. However, flipflop 162 is still receiving a low level signal at its $\overline{R}$ input terminal which overrides any triggering signal applied to the C input terminal.

About 80 milliseconds after the ENTER key 22 is depressed multivibrator 120 returns to its initial state and its Q output drops to the low level. The output of NOR 138 rises to the high level so long as lead 36 is at the low level and this positive-going signal is applied over lead 140 to trigger flipflop 132 into the set condition so that its Q output goes high and its $\overline{Q}$ output goes low. This terminates the overriding set signal applied to flipflop 150 and the overriding reset signals applied to flipflops 134, 162 and 168. The overriding reset signal applied to flipflop 146 terminates when the output of NOR 138 (i.e. PRESET) rises to the high level. This completes the reset and transfer routine.

The reset and transfer routine just described is also performed when the power is turned on. The turning on of the power causes a rise in voltage on the lead 124 (FIG. 4) in the same manner as the operation of the ENTER key 22. Therefore, the sequence of operations for loading the counter 18 and resetting the logic circuits 16 is exactly the same when the power is turned on as when the ENTER key 22 is depressed. It may be noted that the capacitor 130 is tied to lead 124 to delay the rise in voltage on the lead 124 when the power is turned on. This enables other voltage conditions in the circuits to stabilize before the positive-going signal on lead 124 triggers the multivibrators 120 and 122.

A modified reset and transfer routine takes place when the count in counter 18 is decremented to 00. During the modified reset and transfer routine, the value set on the thumbwheel switches 20 is entered into the counter 18 as described above, but certain flipflops in the control circuits 16 are not initialized as is done in a complete reset and transfer routine.

In FIG. 4, the signal 01 on lead 34 drops to the low level as the count in counter 18 changes from 01 to 00. The signal 01 triggers multivibrators 120 and 122 to initiate the modified reset and transfer routine. However, flipflop 132 is not reset before multivibrators 120 and 122 are triggered. Since flipflop 132 is normally set, it will not change state during the modified reset and transfer routine. Therefore, the $\overline{\text{ENTER}}$ signal will not set flipflop 150 and the ENTER signal will not reset flipflops 134, 162 and 168. Except for these differences, the modified routine is the same as the basic reset and transfer routine.

MODE DETERMINATION

Since the present invention performs automatic pagination or automatic line finding when the typewriter system 8 is in the automatic playback mode, and performs normal pagination and normal line finding when the typewriter system 8 is not in the automatic playback mode, it is necessary to provide to the logic circuits of FIGS. 4 and 5 signals indicating what mode the automatic typewriter system 8 is in. Furthermore, since the action keys MARK, WORD, LINE, PARAGRAPH, CHARACTER and AUTO are momentary contact switches, some means must be provided for storing an indication of whether the AUTO action or some other action key was the last one depressed. Flipflop 168 is provided for this purpose.

The output of the AUTO key switch is the signal XAUTO. It is connected through an interface circuit 186 and an inverter 188 to one input of NAND 166. The signal XAUTO is normally at the low level but upon depression of the AUTO key the signal rises to the high level. Inverter 188 inverts the high level signal so that a low level signal is produced to block NAND 166. This sets the flipflop 168 so that a high level signal LSTA appears on lead 170 and a low level signal appears on lead 190.

The signals XMARK, XWORD, XLINE, XPARA, and XCHAR are derived from the switches associated with the FIND MARK, WORD, LINE, PARAGRAPH, and CHARACTER action keys, respectively. Each of these signals is connected through a diode and an interface circuit 192 to one input of NOR 160. The signals XMARK, XWORD, XLINE, XPARA, and XCHAR are normally at the low level so that the junction 194 is held at the low level. When one of the keys MARK, WORD, LINE, PARA or CHAR is depressed, the signal from that key rises to the high level thereby raising the voltage at junction 194. This blocks diode 196 so that the signal on lead 198 rises to the high level. This signal is inverted by NOR 160 and applied to one input of NAND 164 to reset the flipflop 168. This causes output lead 170 from the flipflop 168 to drop to the low level while the output of lead 190 rises to the high level. Thus, if the AUTO key is the least action key depressed the flipflop 168 is in the set condition, but if the MARK, WORD, LINE, PARA of CHAR action key was the last key depressed then the flipflop 168 is in the reset condition.

In order to place the automatic typewriter system 8 in the AUTO playback mode it is not only necessary that the AUTO action key be the last action key depressed, but the PLAYBACK mode key must also be depressed. The mode keys are not momentary keys as are the action keys but instead produce a continuous signal when they are depressed.

The output of the PLAYBACK key is the signal $\overline{\text{XPLAY}}$. This signal is applied through the interface circuit 202 to one input of NOR 200. The output of NOR 200 is connected to one input of a NAND 204. The output of the EDIT mode key is the signal $\overline{\text{XEDIT}}$. This signal is applied through an interface circuit 206 to a junction point 208. The output of the SKIP mode key is the signal $\overline{\text{XSKIP}}$. This signal is applied through an interface circuit 210 to the junction point 208. The junction point 208 is connected by lead 212 to an input of NAND 204.

As long as the EDIT mode and SKIP mode keys are not depressed, the signals $\overline{\text{XEDIT}}$ and $\overline{\text{XSKIP}}$ are both at a high level thus holding the junction point 208 and one input of NAND 204 at the high level.

NAND 204 is connected by lead 214 to the D input of flipflop 150. The lead 214 is at a high level when the automatic typewriter system 8 is not in the automatic playback mode and is at the low level when the typewriter system 8 is in the automatic playback mode. When the operator depresses the PLAYBACK mode key it drives one input of NOR 200 to the low level. When the operator subsequently depresses the AUTO key the XAUTO signal sets flipflop 168 so that a low level signal is applied over lead 190 to the second input of NOR 200. NOR 200 produces a high level output to NAND 204 which is also receiving a high level signal over input lead 212. Therefore, the output of NAND 204 drops to the low level.

If either the EDIT mode key or the SKIP mode key is depressed, the corresponding signal $\overline{\text{XEDIT}}$ or $\overline{\text{XSKIP}}$ drops to the low level thereby driving junction point 208 to the low level. This low level signal passes over lead 212 to block NAND 204 thereby driving the voltage on lead 214 to the high level.

From the foregoing description it is seen that when the typewriter system 8 is in the AUTO PLAYBACK mode flipflop 168 produces the high level signal LSTA and controls the application of a low level signal over lead 214 to the D input of flipflop 150. On the other hand, when the typewriter system 8 is not in the AUTO PLAYBACK mode, LSTA is at the low level and the input to flipflop 150 over lead 214 is at the high level. The signal LSTA on lead 170 and the signal on lead 214 together define the AUTO playback mode.

NORMAL PAGINATION

If the system 8 is not operating in the automatic playback mode, it may be used to provide the operator with a positive end of page indication. This is accomplished as follows. The operator positions a form in the typewriter index mechanism **10*b* to the first line on which typing is to occur. The operator sets into the thumbwheel switches 20 an indication of the maximum number of lines to be typed on the form. The operator then depresses the ENTER key 22 so that the value set into the thumbwheel switches 20 is entered into the counter 18 of FIG. 3. The reset and transfer routine also initializes the logic circuits 16 so that the flipflop 168 (FIG. 5) is reset and the flipflop 150 is set. With flipflop 168 reset a positive signal is applied over lead 190 and through NOR 200 and NAND 204 to the D input of flipflop 150. As long as this input is held at the high level the flipflop 150 cannot be triggered to the reset state so it remains in the set state. With flipflop 168 reset, the signal LSTA is at a low level and thus conditions flipflop 136 (FIG. 4) so that flipflop 136** cannot be subsequently set when its C input rises to the high level.

After the ENTER key 22 has been depressed the operator may begin normal typing. At the end of each line the operator depresses the CARRIER RETURN key on the typewriter keyboard so that the index mechanism 10*b* spaces the form upwardly one line while the type carrier mechanism is being returned to the left margin. Each depression of the CARRIER RETURN key generates the signal XCR (FIG. 4) and each XCR signal causes one decrement signal to appear on lead 32 as previously described. This decrement signal reduces by one the count in the counter 18.

Each XCR signal also tests the flipflop 134 (FIG. 4) to determine if the count standing in counter 18 has been decremented to 01. Each XCR signal produces a low level output from NAND 88 that is inverted by an inverter 216 and applied to the C input of flipflop 134. The D input of flipflop 134 receives the signal 01 which is at a low level as long as the count in counter 18 is at 01. Since the flipflop 134 was reset during the transfer and reset routine the positive-going pulses at its C input have no effect on the flipflop 134 as long as the D input remains at the low level.

For purposes of illustration, assume that the operator initially entered the value 10 into the thumbwheel switches before depressing the ENTER key 22. After nine lines have been typed the ninth CARRIER RETURN key depression reduces the count in counter 18 to 01 and returns the carrier mechanism to the left margin so that the tenth line may be typed. After the tenth line is typed, and when the operator hits the CARRIER RETURN KEY for the tenth time, the signal XCR on lead 92 again causes a decrement signal to appear on lead 32 and a further high level pulse on lead 218.

The high level signal on lead 218 sets flipflop 134 since the count in the counter 18 is 01 and the D input to the flipflop 134 is at the high level. The flipflop 134 produces a high level output signal on lead 220 that is applied to the base of a transistor 222. The emitter of transistor 222 is connected to ground through a resistor and the collector is connected to the base of a further transistor 224. The emitter of transistor 24 is connected to a positive voltage source and the collector is connected by way of a lead 226 back to the lead 92.

The transistor 224 is effectively connected in parallel with the carrier return switch in the typewriter 10. Therefore, when flipflop 134 is set to turn on transistor 222, the transistor 224 is in turn turned on to apply a continuous carrier return signal to the carrier return mechanism. Since the typewriter keyboard normally locks up during carrier returns, this effectively locks up the typewriter 10 so that no further typing can be done, and provides the operator with a positive indication that the end of a page has been reached.

Immediately after flipflop 134 is set, the tenth decrement signal reduces the count in counter 18 to zero. At this time the signal 00 on lead 36 rises to the high level while the signal 01 on lead 34 drops to the low level. The signal 01 triggers multivibrators 120 and 122 initiating a modified reset and transfer routing as previously described to again transfer the count from the thumbwheel switches 20 to the counter 18. During this modified reset and transfer routine the $\overline{Q}$ output of flipflop 132 and the Q output of flipflop 136 both remain at the low level so that the flipflop 134 is not reset. Therefore, the transistor 224 remains in the conducting state and locks up the typewriter 10 by continuously energizing the carrier return mechanism.

The system of FIG. 1 may be returned to normal activity merely by depressing the ENTER key 22 at which time the system of FIG. 1 goes through a normal reset and transfer routine as previously described to initialize the logic circuits 16 and transfer the count from the thumbwheel switches 20 to the counter 18.

AUTOMATIC PAGINATION

When the typewriter system 8 is operating in the automatic playback mode the present invention automatically stops playback after a predetermined number of lines have been printed on a page. The number of lines to be typed is set into the thumbwheel switches 20 by the operator who then depresses the ENTER key 22. Actuation of the ENTER key 22 causes the previously described reset and transfer routine to take place during which the value set into the thumbwheel switches 20 is transferred to the counter 18 and the logic circuits 16 are reset. Next, the operator depresses the PLAYBACK mode key at which time the signal $\overline{\text{XPLAY}}$ (FIG. 5) drops to the low level. Since the flipflop 168 was reset during the reset and transfer routine the signal on lead 190 is at a high level hence the signal $\overline{\text{XPLAY}}$ causes no change in the output of NOR 200.

Next, the operator depresses the AUTO playback key. This locks up the typewriter keyboard and causes the keyboard circuits to emit a high level signal XAUTO and a low level signal $\overline{\text{IKBLK}}$. The low-going signal $\overline{\text{IKBLK}}$ is applied over lead 230 (FIG. 5) to the C input of flipflop 150 but has no effect on the state of the flipflop 150. The XAUTO signal is inverted by amplifier 188 and applied to flipflop 168 thereby setting the flipflop 168. Lead 190 from the flipflop drops to the low level and this signal is transmitted through NOR 200 and NAND 204 to the D input of flipflop 150. Again, this signal has no effect on the flipflop 150. The high level output of flipflop 168 appearing on lead 170 is applied to the D input of flipflop 136 (FIG. 4).

When the operator depresses the AUTO key the typewriter system 8 begins to playback and type out the message recorded on the magnetic record. At the end of each typing line a CARRIER RETURN code recorded on the record causes the carrier return mechanism to return to the left margin. As this occurs a signal XCR appears on lead 92 (FIG. 4) thereby causing multivibrators 80 and 82 to generate a decrement signal on lead 32 to decrement the counter 18. The typewriter system 8 continues typing out the message line for line and executing a carrier return at the end of each line until the count in counter 18 is decremented to 01. At this time the output signal 01 from the counter 18 rises to the high level and is applied over lead 34 to the C input of flipflop 136. Since the signal LSTA is at the high level, the positive-going signal 01 sets flipflop 136 so that the lead 232 rises to the high level. The high level signal is applied through NOR 152 to hold flipflop 134 in the reset state. The lead 132 is also connected to the base of a transistor 234. The emitter of transistor 234 is connected through a resistor to ground and the collector is connected directly to the base of a further transistor 236. The emitter of transistor 236 is connected to a source of positive voltage and the collector is connected by a lead 238 back to the XLINE input lead of FIG. 5.

The transistor 236 is connected in parallel with the LINE action key of the typewriter keyboard. Therefore, when the transistor 236 is rendered conductive it causes one line of the message to be typed out and a carrier return to be executed.

When flipflop 136 is set as the signal 01 rises to the high level, the output from the flipflop 136 turns on transistor 234 and this turns a transistor 236 thereby generating the signal LINE on lead 238. This signal is applied back over the XLINE input lead to the typewriter keyboard circuits 10*a* to cause the typewriter 10 to type out the last line of the message. The signal also takes the automatic typewriter system 8 out of the AUTO mode and the signal $\overline{\text{IKBLK}}$ rises to the high level. However, since the D input of the flipflop 150 is at the high level, the state of the flipflop 150 is not changed by the $\overline{\text{IKBLK}}$ signal.

In FIG. 5, the signal LINE on lead 238 is inverted by NOR 160 and resets the flipflop 168 so that the signal on lead 190 rises to the high level while the signal on lead 170 drops to the low level. The signal on lead 190 causes a high level input to flipflop 150 over lead 214 while the low level signal on lead 170 is applied directly to flipflop 136 (FIG. 4).

At the end of the last line of typing the typewriter 10 again executes a carrier return and the signal XCR on lead 92 again causes a signal to be generated on lead 32 to decrement the counter 18 to zero. At the same time, a signal is generated on lead 218 but this signal cannot affect the flipflop 134 which is being held in the reset state at this time by the output from the flipflop 136.

As the counter 18 is decremented to zero the signal 01 from the counter 18 drops to the low level. In FIG. 4, this signal is applied over lead 34 to the A inputs of multivibrators 120 and 122 and, since the B inputs of multivibrators 120 and 122 are at the high level the negative-going signal on lead 34 triggers both multivibrators 120 and 122.

This initiates a modified reset and transfer routine as previously described. During this routine the value set into the thumbwheel switches 20 is again entered into the counter 18 and the logic circuits 16 including flipflop 136 are reset. The operator may now insert a new sheet of paper into the typewriter indexing mechanism 10*b* so that it is ready for typing on the first line, and depress the AUTO action key again. This causes the typewriter system 8 to again operate in the automatic playback mode so that another page is automatically played back and typed. At the end of each line a carrier return operation takes place and the counter 18 is decremented. When the counter 18 again reaches a count of 01 another LINE signal is generated to take the typewriter system 10 out of the AUTO action and place it in LINE action. At the end of the line a carrier return signal causes the counter 18 to be decremented to zero and this causes another modified reset and transfer routine during which the count in the thumbwheel switches 20 is again set in the counter 18 and the logic circuits 16 are reset.

From the above description it is seen that in the automatic pagination mode the operator merely places a sheet of paper in position for the first line of typing and hits the playback mode and AUTO action keys. The typing of the page then takes place automatically until the last line of the page has been typed at which time the typewriter 10 stops. The operator may then remove the typed page, insert a new page and depress the AUTO key to repeat the operation.

NORMAL LINE FINDING

Use of the line finding feature requires the use of continuous forms in the typewriter indexing mechanism 10*b*. The operator loads the form into the indexing mechanism 10*b* so that the first line of the first sheet of the form is in typing position. The operator then sets into the thumbwheel switches 20 a value corresponding to the number of lines between the first typing line on the first sheet of the form and the first typing line of the next consecutive sheet. The operator then depresses the ENTER key 22 to initiate a transfer and reset operation. This resets the logic circuits 16 and loads into counter 18 the value that has been set into the thumbwheel switches 20. Since it is assumed that this is a normal line finding operation, the operator may now operate the typewriter system 8 in any mode other than the AUTOMATIC PLAYBACK mode. At the end of each line of typing a carrier return operation is executed and the signal XCR on lead 92 causes a decrement signal to be produced on lead 32 and applied to the counter 18.

Any time before the counter 18 has been decremented to 00, the operator may terminate typing and cause the continuous form to be indexed to the first line of the next page. When the operator depresses the INDEX key 24 the signal $\overline{\text{XINDEX}}$ sets flipflop 174 (FIG. 5) thus producing a high level signal on lead 176. This signal is applied through NOR 178 and NOR 110 (FIG. 4) to the B input of multivibrator 84. As previously explained, when multivibrator 84 is triggered it produces the signal $\overline{\text{INDEX}}$ on lead 38 to advance the typewriter index mechanism 10*b* by one line, and after an interval of 80 milliseconds triggers multivibrator 86. Multivibrator 86 produces a signal that passes through NAND 190 and over lead 132 to decrement the counter 18. At the end of 80 milliseconds the Q output from multivibrator 86 again triggers multivibrator 84 if the signal on lead 108 is at the low level, that is, if the flipflop 174 is still set. Thus, as long as flipflop 174 is set multivibrator 84 continues producing $\overline{\text{INDEX}}$ pulses and for each of these pulses multivibrator 86 produces an output signal to decrement the counter 18.

The indexing operation stops when the count in the counter 18 has been reduced to zero. As the counter in the counter 18 changes from 01 to 00, the signal 01 on lead 34 at the output of the counter 18 drops to the low level and in FIG. 4 triggers multivibrators 120 and 122. This initiates the modified transfer and reset routing during which the count in the thumbwheel switches 20 is again set into the counter 18 and the logic circuits 16 are reset. During this routine the output from multivibrator 120 over lead 182 holds multivibrator 84 reset. Also during this interval, the preset signal on lead 30 is applied to NAND 142 (FIG. 5) to reset the flipflop 174.

The continuous form is now positioned for typing on the first line of the next page and the operator may resume typing.

AUTOMATIC LINE FINDING

Automatic line finding is defined as that operation whereby, after the automatic typing of the text on a first sheet of a continuous form is completed, the continuous form is indexed to the first typing line of the next consecutive sheet, and automatic playback is resumed. Automatic line finding occurs when the typewriter system 8 is in the AUTOMATIC PLAYBACK mode and the keyboard is unlocked before the count in the counter 18 has been decremented to 01.

Assume for purposes of illustration that an operator has a set of continuous forms and that each sheet of the form is to have the name of a different individual typed thereon. Assume further that the list of names has previously been recorded on a magnetic record. In preparing the record the operator has recorded a carriage return and then a stop code following each name.

The operator sets into the thumbwheel switches 20 a number corresponding to the number of printing lines between the first printing lines of two consecutive forms. Next, the operator depressed the ENTER key 22 thereby initiating the transfer and reset routine during which the valve set into the thumbwheel switches 20 is transferred into counter 18 and the logic circuits 16 are reset. The operator then depresses the PLAY mode key and, although the signal $\overline{\text{XPLAY}}$ (FIG. 5) drops to the low level nothing happens because flipflop 168 has been reset and is applying a high level signal to NOR 200 over lead 190.

Automatic playback of the first name on the first sheet of the continuous form begins when the operator depresses the AUTO action key. At the same time, the signal XAUTO (FIG. 5) rises to the high level and sets flipflop 168. The high level output signal LSTA from the flipflop 168 is applied to the D input of flipflop 136. The low level output from flipflop 168 appearing on lead 190, in combination with the signal $\overline{\text{XPLAY}}$ which is also low at this time, causes NOR 200 to produce a high level output signal. Since the signals $\overline{\text{XEDIT}}$ and $\overline{\text{XSKIP}}$ are also high at this time NAND 204 produces a low level output signal on lead 214 that is applied to the D input of flipflop 150. Since the keyboard is locked up as soon as the system 8 enters the AUTOMATIC PLAYBACK mode, the signal $\overline{\text{IKBLK}}$ is at a low level.

As the first name is automatically played back from the record and typed on the first sheet of the continuous form, nothing further happens in the line finding and line counter circuits of FIGS. 4 and 5. At the end of the first name the typewriter system 8 executes a carrier return and the signal XCR (FIG. 4) causes a DECREMENT signal on lead 32 to decrement counter 18. Next, the typewriter system 8 senses the recorded STOP code. This terminates the AUTO PLAYBACK mode in the typewriter system 8 and unlocks the keyboard 10 so that the signal $\overline{\text{IKBLK}}$ (FIG. 5) rises to the high level. The positive-going signal $\overline{\text{IKBLK}}$ resets flipflop 150 since the D input of the flipflop 150 is receiving a low level input signal.

The $\overline{\text{Q}}$ output of flipflop 150 is connected to the base of a transistor 250. The emitter of the transistor 250 is connected to ground through a resistor and the collector is connected to the base of a further transistor 252. The emitter of transistor 252 is connected to a source of positive voltage and the collector is connected by way of lead 254 to the XCHAR input lead.

The transistor 252 is effectively connected in parallel with the CHARACTER/STOP action key on the typewriter keyboard and when the transistor 252 is turned on it causes the same action as if the CHARACTER/-STOP key were depressed. Therefore, when flipflop 150 is reset to turn on transistors 250 and 252, the signal on lead 254 passes through NOR 160 to reset the flipflop 168. The signal on lead 254 also flows back into the typewriter keyboard circuits **10*a*** where it initiates action to play back the next character.

While the character following the STOP code is being processed by the typewriter system 8, the keyboard is again locked and the signal $\overline{\text{IKBLK}}$ drops to the low level. Also, while the character following the STOP code is being processed in index sequence is initiated. The index sequence is initiated by the $\overline{\text{Q}}$ output of flipflop 150 at the time this output turns on the transistors 250 and 252. The positive-going output of flipflop 150 triggers flipflop 146 into the set state so that a positive-going signal appears on lead 180. This signal is inverted by NOR 178 and applied over lead 108 to FIG. 4 where it drives one input of NOR 110 to the low level. The second input of NOR 110 is already at the low level so NOR 110 produces a positive-going output signal to trigger multivibrator 84 and initiate the index sequence. During the index sequence multivibrators 84 and 86 repeatedly cycle to produce a sequence of $\overline{\text{INDEX}}$ pulses for advancing the typwriter index mechanism **10*b* and a sequence of DECREMENT pulses for decrementing the counter 18. While the index sequence is being carried out, the automatic typewriter system 8 completes processing of the character following the STOP code and the keyboard is unlocked so that the signal $\overline{\text{IKBLK}}$ returns to the high level. Since flipflop 168 has been reset so that the signal on lead 214 is at the high level, the positive going signal $\overline{\text{IKBLK}}$ again sets flipflop 150 thereby turning off transistors 250 and 252. The negative going $\overline{\text{Q}}$ output of flipflop 150 does not trigger flipflop 146 but it does apply a low level signal to one input of NOR 184.**

The index sequence continues until the count in the counter 18 has been decremented to 00. At this time the continuous form has been advanced so that the first typing line of the second sheet is in the typing position. As the counter 18 goes from a count of 01 to a count of 00, the signal 01 on lead 34 drops to the low level. This negative-going signal triggers multivibrators 120 and 122 to initiate a modified reset and transfer routine. As multivibrator 120 is triggered its Q output goes high and is inverted by NOR 138 to produce the low level PRESET signal. In FIG. 5, the PRESET signal is applied over lead 144 to the $\overline{\text{R}}$ input of flipflop 146. This resets flipflop 146 and its Q output drops to the low level. The signal on lead 180 drops to the low level and since the signal on lead 176 is also at the low level the FIND signal on lead 108 rises to the high level. This signal is applied to NOR 110 in FIG. 4 and drives the output of NOR 110 to the low level thereby terminating the index sequence.

When flipflop 146 is reset it applies a low level input signal to NOR 184 which is further receiving a low level signal from flipflop 150. NOR 184 produces a positive-going output signal to set flipflop 162. The Q output of flipflop 162 is connected to the base of a transistor 260. The emitter of transistor 260 is connected to ground through a resistor and the collector is connected to the base of a further transistor 262. The emitter of transistor 262 is connected to a source of positive voltage and its collector is connected by lead 264 to the XAUTO input lead.

The transistor 262 is effectively connected in parallel with the AUTO action kay on the typewriter keyboard. Therefore, when flipflop 162 is set to thereby turn on transistors 260 and 262, the signal on lead 264 is applied back over the XAUTO input lead to the typewriter keyboard circuits 10*a* to again place the system in the AUTOMATIC PLAYBACK mode. The signal on lead 164 is also inverted by inverter 188 and applied to flipflop 168 thereby again setting the flipflop 168. This drives lead 170 to the high level while the signal on lead 214 drops to the low level.

The system 8 is again in the AUTOMATIC PLAYBACK mode and automatically begins typing the second name on the first line of the second sheet of the continuous form. As the first character is being processed the signal BSYTIN goes high and NOR 158 produces a low level output signal to reset flipflop 162. This turns off transistors 260 and 262 once the AUTOMATIC PLAYBACK mode had been restarted.

It should be noted that at the same time the index sequence is terminated the count set into the thumbwheel switches 20 is transferred to the counter 18. The preset signal is applied to the $\overline{PE}$ input terminal of the shift registers 50 and 50' thereby enabling this input. The output of multivibrator 122 is applied over lead 31 to the $\overline{CP}$ inputs of the shift registers 50 and 50' thereby accomplishing the parallel transfer from the thumbwheel switches 20 to the counter 18.

Once the AUTOMATIC PLAYBACK mode has been resumed, the system 8 will type the second name on the first line of the second sheet of the form and then initiate another indexing operation to bring the first line of the third sheet into the typing position. This cycle of operation continues until the system has automatically typed one name on the first line of each sheet.

It will be understood that the preceding example represents a very simple application of the present invention and is chosen to illustrate the operation of the automatic line finding circuits. Obviously, more than one line may be typed on each sheet and/or the number of lines types on each sheet need not be the same. On the other hand, the same message, recorded only once on a magnetic record, may be repeated on each sheet of the continuous form without operator intervention. This may be accomplished by recording a REPEAT code as the character following the STOP code when the magnetic record is being prepared. Thus, while the indexing operation is taking place the REPEAT character is being processed and the automatic typewriter system 8 searches the magnetic record for the beginning of the message. Since all of the circuits for executing the REPEAT code are part of the prior art typewriter system 8 the repeat operation will not be explained in detail.

Some models of the Sperry Rand Word Processing System employ two magnetic media and permit alternate playback from first one and then the other of the magnetic media. An ALTERNATE code is recorded at the end of a message segment on one medium when playback is to switch back to the other medium. In accordance with the present invention the ALTERNATE code may be recorded after the STOP code so that line finding operations may be performed in an operation where a portion of the message is recorded on one magnetic medium or another portion is recorded on another medium.

If the character following the STOP code is not a REPEAT code or an ALTERNATE code, it should be a LINK code. This LINK code permits continued typing without carriage return. Again, since the operation of the typewriter system 8 in response to the ALTERNATE codes and LINK codes is well known, it is not explained here.

AUTOMATIC OVERRIDE

The automatic pagination and line finding features of the present invention may be rendered inactive by the operator. This is accomplished by setting the value 00 into the thumbwheel switches 20 and depressing the ENTER key 22. Depression of the ENTER key 22 initiates a transfer and reset routine during which the logic circuits of FIGS. 4 and 5 are reset and the value 00 is entered into the counter 18. With the counter 18 set at 00, the signal 00 on lead 36 is at the high level. This signal is inverted by NOR 138 (FIG. 4) and applied over lead 30 to FIG. 5 where it resets the flipflop 174. The flipflop 174 produces a low level signal on lead 176 to one input of NOR 178. The PRESET signal on lead 30 is also applied over lead 144 to reset flipflop 146 and the Q output of flopflop 146 drops to the low level. With both inputs at the low level, NOR 178 produces a high level output signal that is applied over lead 108 to FIG. 4 where it inhibits cycling of the index multivibrators 84 and 86.

When the count in counter 18 is standing at 00, depression of the INDEX key 24 causes the index mechanism 10*b* of the typewriter 10 to be spaced one line. As the INDEX key 24 is depressed the signal $\overline{XINDEX}$ (FIG. 5) momentarily drops to the low level and then returns to the high level. This signal is inverted by NAND 172 and inverted again by NOR 178 so as to momentarily drive the lead 108 to the low level. In FIG. 4, with the lead 108 at the low level NOR 110 produces a positive-going signal to trigger multivibrator 84. The multivibrator 84 produces one INDEX pulse on lead 38 to advance the typewriter indexing mechanism 10*b*. Subsequently, multivibrator 84 triggers multivibrator 86 to produce a decrement pulse. When multivibrator 86 returns to its initial state and the signal on lead 112 drops to the low level, the FIND signal on lead 108 has already returned to the high level hence a second indexing cannot take place.

While a specific preferred embodiment of the invention has been described in detail, it will be understood that various modifications and substitutions may be made therein without departing from the spirit and scope of the invention as defined by the appended claims.

The embodiments of the invention in which an exclusive property or privilege are claimed are defined as follows:

1. In an automatic typewriter system having a typewriter with a continuous forms indexing means and a playback/record means for recording typed data or playing back recorded data, said system being selectively operable in a plurality of modes including an automatic playback mode in which recorded data is played back and typed one character at a time, said system also producing mode signals and carrier return signals, the improvement comprising:

switch means settable to represent a line count;

counter means;

means for transferring said line count from said switch means to said counter means;

first circuit means responsive to each said carrier return signal for decrementing the line count in said counter means;

means for producing an index signal;

second circuit means responsive to said index signal, said counter means, and said mode signals for generating a find signal;

third circuit means responsive to a fine signal for generating first and second sequences of pulses;

means responsive to said first sequence pulses for advancing the continous forms indexing means of said typewriter; and, means for applying said second sequence of pulses to said counter means to decrement the line count therein.

2. The improvement as claimed in claim 1 wherein:

said second circuit means includes means responsive to said indexsignal, a signal indicating the count in said counter means is greater than a predetermined value, and a signal indicating said system is not in the automatic playback mode for generating said find signal over an interval of time sufficient to permit said second sequence of pulses to decrement the count in said counter means to zero and permit said first sequence of pulses to advance said continuous forms indexing means to bring the first line of a next sheet of the continuous form into typing position; and, said switch means is set to a value representing the number of lines between the first typing lines on consecutive sheets of continuous form.

3. The improvement as claimed in claim 2 wherein said means for producing said index signal includes a manual key means and storage means for storing an indication that said key means has been actuated.

4. The improvement as claimed in claim 3 including means responsive to a zero count in said counter means for resetting said storage means and transferring the line count from said switch means to said counter means.

5. The improvement as claimed in claim 2 wherein said predetermined value is one.

6. In an automatic typewriter system having a typewriter with a continuous forms indexing means and a playback/record means for recording typed data or playing back recorded data, said system being selectively operable in a plurality of modes including an automatic playback mode in which recorded data is played back and typed one character at a time, said system also producing mode signals and carrier return signals, the improvement comprising:

switch means settable to a line count representing the number of lines between the first typing lines of two consecutive sheets of a continuous form;

counter means;

means for transferring the line count in said switch means to said counter means;

first circuit means responsive to each carrier return signal for decrementing the count in said counter means; and, second circuit means responsive to said counter means and a signal from said typewriter indicating termination of said automatic playback mode for generating a find signal;

third circuit means responsive to said find signal for generating pulses to index said continuous forms indexing means and decrement said counter means; and, fourth circuit means responsive to a zero count in said counter means for activating said means transferring the line count in said switch means, terminating said find signal, and applying a signal to said typewriter to restart operation in said automatic playback mode.

7. The improvement as claimed in claim 6 wherein said system includes means responsive to a recorded stop code for generating said signal indicating termination of said automatic playback mode, said improvement further comprising:

means for generating a character signal in response to said signal indicating termination of said automatic playback mode; and, means for applying said character signal to said typewriter whereby the recorded character following said stop code is processed by said system while said continuous forms indexing means is being indexed.

8. The improvement as claimed in claim 7 wherein said second circuit means comprises means for generating said find signal if the count in said counter means is greater than one when the signal indicating termination of the automatic playback mode occurs.

9. The improvement as claimed in claim 8 wherein said third circuit means comprises means for generating sequences of indexing and decrement signals as long as said third circuit means receives said find signal.

10. In an automatic typewriter system having a typewriter with a form indexing means and a playback-/record means for recording typed data or playing back recorded data, said system being selectively operable in a plurality of modes including an automatic playback mode in which up to a page of recorded data is played back and typed without operator intervention, said system also having means for producing mode signals and carrier return signals, the improvement comprising:

switch means settable to represent a line count;

counter means;

means for transferring said line count from said switch means to said counter means;

first circuit means responsive to each said carrier return signal for decrementing the line count in said counter means;

second circuit means responsive to said counter means and said mode signals for producing a line signal for terminating the automatic playback mode of said system when said system is in the automatic playback mode and the count in said counter means is decremented to a predetermined count; and said line signal changing said system to a line mode wherein said system plays back and types one further line of data, executes a carrier return, and stops.

11. The improvement as claimed in claim 10 and further including means responsive to said counter means as said counter means is decremented to a second predetermined count for activating said means for transferring the line count from said switch means to said counter means.

12. The improvement as claimed in claim 10 wherein said line count set into said switch means has a value equal to the maximum number of lines to be typed on a form.

13. The improvement as claimed in claim 10 and further comprising:

third circuit means responsive to said counter means and said mode signals for producing a further signal when the line count in said counter means is decremented to a second predetermined count and said system is not in the automatic playback mode, said system including means responsive to said further signal for locking said typewriter.

14. The improvement as claimed in claim 13 wherein the value set into said switch means has a value equal to the maximum number of lines to be typed on a form, said first predetermined count is one and said second predetermined count is zero.

* * * * *